US010139101B2

(12) United States Patent
Pires

(10) Patent No.: US 10,139,101 B2
(45) Date of Patent: Nov. 27, 2018

(54) PERSONAL DEFENSE DEVICE

(71) Applicant: C2C Invent LLC, Basking Ridge, NJ (US)

(72) Inventor: Liselle Ann Pires, Seattle, WA (US)

(73) Assignee: C2C INVENT, LLC, Basking Ridge, NJ (US)

( * ) Notice: Subject to any disclaimer, the term of this patent is extended or adjusted under 35 U.S.C. 154(b) by 0 days.

(21) Appl. No.: 15/714,653

(22) Filed: Sep. 25, 2017

(65) Prior Publication Data

US 2018/0087769 A1 Mar. 29, 2018

(30) Foreign Application Priority Data

Sep. 26, 2016 (IN) ..... 201611032820

(51) Int. Cl.

| | |
|---|---|
| ***F21V 33/00*** | (2006.01) |
| ***G08B 15/00*** | (2006.01) |
| ***F41H 9/10*** | (2006.01) |
| ***G08B 15/02*** | (2006.01) |

(52) U.S. Cl.

CPC ..... *F21V 33/0076* (2013.01); *F41H 9/10* (2013.01); *G08B 15/004* (2013.01); *G08B 15/02* (2013.01)

(58) Field of Classification Search

CPC ..... F21V 33/0076; F41H 9/10; G08B 15/004; G08B 15/02

USPC ..... 222/192

See application file for complete search history.

(56) References Cited

U.S. PATENT DOCUMENTS

| | | | | | |
|---|---|---|---|---|---|
| 4,223,804 | A * | 9/1980 | Morris | B65D 83/201 | 116/214 |
| 4,449,474 | A * | 5/1984 | Mariol | G08B 15/02 | 116/137 R |
| 5,446,985 | A * | 9/1995 | Chen | F41H 9/10 | 222/113 |
| 5,476,192 | A * | 12/1995 | Julinot | B65D 83/384 | 116/81 |
| 5,549,220 | A * | 8/1996 | Whalen | B05B 9/0805 | 116/81 |
| 5,556,003 | A * | 9/1996 | Johnson | F41H 9/10 | 116/DIG. 44 |
| 5,795,054 | A * | 8/1998 | Booty, Jr. | F41H 9/10 | 222/162 |
| 5,842,602 | A * | 12/1998 | Pierpoint | F41H 9/10 | 222/1 |
| 6,052,051 | A * | 4/2000 | Whalen | F41H 9/10 | 222/1 |
| 7,069,926 | B2 * | 7/2006 | Skellern | B05B 15/00 | 128/200.11 |
| 7,100,602 | B2 * | 9/2006 | Cole | B05B 15/00 | 128/200.11 |
| 7,827,726 | B2 * | 11/2010 | Stokes | F41C 23/16 | 362/111 |

(Continued)

*Primary Examiner* — Paul R Durand
*Assistant Examiner* — Andrew P Bainbridge
(74) *Attorney, Agent, or Firm* — Patterson + Sheridan, LLP

(57) ABSTRACT

A personal defense device which is easy to hold, target and actuate includes means for releasing attack repellant chemical from a canister in a direction in which the device is aimed. Further, the personal defense device includes an alarm, a flash light source, a battery indicator, a target pointer and a canister containing the attack repellant chemical to stun, disorient or disable an attacker and/or to attract the attention of nearby persons for assistance especially in an emergency.

19 Claims, 9 Drawing Sheets

(56) References Cited

U.S. PATENT DOCUMENTS

| | | | | |
|---|---|---|---|---|
| 8,245,878 | B2 * | 8/2012 | Smith | F41H 9/10 222/3 |
| 8,397,953 | B2 * | 3/2013 | Kaufman | B65D 83/206 222/113 |
| 9,989,335 | B2 * | 6/2018 | Purvis | F41H 1/02 |
| 2014/0252036 | A1 * | 9/2014 | Ballard | F41C 33/0236 222/113 |
| 2015/0216160 | A1 * | 8/2015 | Spence | A01M 29/18 367/139 |
| 2016/0196736 | A1 * | 7/2016 | Nolan | G08B 25/016 340/6.1 |
| 2018/0087769 | A1 * | 3/2018 | Pires | F21V 33/0076 |

* cited by examiner

PERSONAL DEFENSE DEVICE

CROSS-REFERENCE TO RELATED APPLICATION

This application claims benefit of Indian Provisional Application Ser. No. 201611032820, filed on Sep. 26, 2016, which is incorporated by reference in its entirety.

BACKGROUND

Field of the Invention

The present invention relates to a personal defense device which is easy to hold, target and actuate. Further, the device can be used to stun, disorient or disable an attacker and/or to attract the attention of nearby persons for assistance especially in an emergency or anticipated emergency.

Description of the Related Art

Despite society's considerable efforts, violent crimes such as kidnapping, rape and murder remain a frequent occurrence in many cities and pose a serious danger for citizens. While governments struggle to find a solution to the violent crime problem, it is left to the individual to do his or her utmost to reduce the risk of becoming a victim.

Various techniques have been employed to reduce the chance of being attacked, most of which are primarily concerned with threat avoidance. Additional defensive techniques and devices have been implemented in order to repel an attacker. One such defense that has been proved effective at stopping an attacker is a device capable of spraying an attack repellant chemical such as pepper, mace and the like. When properly used, such a device can be an effective defensive weapon which is non-lethal and affordable.

However, conventional devices for spraying attack repellant chemicals are sometimes ineffective due to being difficult to use properly in an attack situation because of their poor design. Specifically, the devices are packaged in a tubular aerosol sprayer with a nozzle on the top, which is difficult to grasp and use in an emergency situation. Furthermore, the nozzle is typically a right angle spray nozzle, actuated by being depressed with the user's finger. Unfortunately, the user's finger often impedes or deflects the spray, or rotates the nozzle such that the spray misses the intended target. Additionally, the aerosol sprayer must be oriented vertically with the nozzle at the highest point or the sprayer will not work properly because propellant will escape through the nozzle when the spray fluid drains away from the nozzle opening, near the bottom of the tubular sprayer. Thus, conventional devices are ineffective or less effective. Furthermore, conventional devices only incapacitate the attacker and completely fail to attract attention of the nearby persons to the victim, thereby decreasing the chance of obtaining any assistance.

These and other attack-repellent devices have left much to be desired from the standpoint of simplicity of construction, their proneness to accidental operation and danger of the attack repellant chemical spilling on the user's clothes or exposed skin. Most of such devices are not re-useable once operated/used.

Therefore, it is desirable to provide a personal defense device that is easy and comfortable to hold, target and actuate, and that includes an alarm for attracting the attention of nearby persons for assistance especially in an emergency.

SUMMARY

The present disclosure relates to a personal defense device which overcomes the above-mentioned disadvantages and meets the recognized need by providing an alarm, a source of flash light, an indicator for battery, a target pointer and a canister containing an attack repellant chemical.

According to an embodiment, the alarm may be selected from a whistle, a piezo buzzer and the like.

According to an embodiment, the source of flash light may be selected from an LED or any conventional source of light capable of producing a high intensity light, e.g. compact fluorescent lamp (CFL) or halogen.

According to an embodiment, the indicator for battery is used to indicate charging of the battery and may be selected from an LED or any conventional source of light e.g. compact fluorescent lamp (CFL) or halogen.

According to an embodiment, the target pointer is used to aim an attacker so that the personal defense device can be used properly. The target pointer may include a laser pointer.

According to an embodiment, the canister includes an attack repellant chemical selected from pepper, mace, a chemical irritant to eyes and/or skin and the like.

According to an embodiment, the canister is replaceable which makes the personal defense device reusable.

According to an embodiment, the personal defense device comprises a reflector assembly, a barrel assembly and a plunger assembly.

According to an embodiment, the reflector assembly is attached to the barrel assembly which is further attached to the plunger assembly. The barrel assembly includes a proximal end and a distal end. The reflector assembly is attached at the distal end of the barrel assembly and the plunger assembly is attached at the proximal end of the barrel assembly.

According to an embodiment, the barrel assembly is attached to the plunger assembly by threaded engagement. Alternatively, any known affixation means or mechanisms either mechanical like snap fit, or adhesive-based or the like can be used to attach the barrel assembly with the plunger assembly.

The reflector assembly comprises a reflector, a lens and a cover. The cover is combined with the lens to protect the reflector from dust or other physical damage. The lens is used to focus the light generated by a flash light source. According to an embodiment, an adhesive is applied on an outside surface of the reflector so that it can be attached to the barrel assembly. Alternatively, the reflector can be attached to the barrel assembly by any known affixation means or mechanisms including threads, snap fit or the like. The reflector assembly is attached at a first opening of the barrel assembly.

According to an embodiment, the barrel assembly comprises a replaceable canister having a compressible nozzle at its distal end. The nozzle is inserted into a spring. A canister housing is provided in the barrel assembly to receive the spring and the canister having the compressible nozzle. Further, the canister housing has a neck formed in its proximal end portion. The neck may have threads or any other engagement means like protrusion, grooves or the like on its outer surface.

The barrel assembly further comprises a PCB (Printed circuit board) housing. The PCB (Printed circuit board) housing is provided above the canister housing to receive a PCB (Printed circuit board) assembly which carries a battery according to an embodiment. According to an alternate embodiment, the PCB assembly carries more than one battery. The PCB (Printed circuit board) assembly further comprises a flash light source, a battery indicator, a target pointer and at least one switch. The PCB housing has a channel which guides insertion of the PCB assembly into the PCB housing. A PCB stopper is attached at an insertion end of the PCB housing to prevent any accidental movement of the PCB assembly out of the PCB housing. A cut out is provided on a top surface of the PCB housing. A cover is attached to the cut out. Further, the cover comprises a horizontal wall and a vertical wall which are provided to cover the PCB assembly and the PCB stopper respectively. A side wall of the PCB housing has a slot to receive a slider button. The slider button activates or deactivates a switch on the PCB assembly to switch ON/OFF both the target pointer and the flash light source. Another side wall of the PCB housing has a slot and a cavity. The slot is to receive a push button. The push button activates or deactivates another switch on the PCB assembly to switch ON/OFF the battery indicator. The battery indicator indicates that the personal defense device is powered ON or OFF and also indicates the charge level or life of the battery. The PCB housing further includes a cavity to receive a light pipe. The light pipe is used for transporting or distributing light from the battery indicator to outside. Light from the flash light source emits out from the reflector assembly at the first opening of the PCB housing while laser beam from the target pointer emits out from a second opening of the PCB housing. A third opening is provided in the canister housing to release the attack repellant chemical from the canister.

According to an embodiment, the plunger assembly has a front end and a rear end. The plunger assembly comprises an upper housing and a lower housing. The upper housing includes an open ended cavity extending from a side surface of the plunger assembly to receive an alarm for example a whistle. The whistle has a passageway to direct a stream of air which is blown by the user. The whistle functions as an alarm either to attract the attention of nearby persons for assistance especially in an emergency or to stun, disorient or disable an attacker. A cavity is formed in the upper housing to receive a holding strap so that the user can carry the personal defense device easily. The lower housing has a hollow cylindrical body. A front end of the lower housing is removably or non-removably engaged with the barrel assembly. The front end of the lower housing receives the barrel assembly and it has internal threads to engage with the threads formed on the neck of the canister housing. Alternately, other engagement means like grooves or protrusions may be provided to engage with the respective protrusions or grooves formed on the neck of the canister housing. A rear end of the lower housing receives a plunger. The plunger has a hollow cylindrical body and an extended head. The hollow cylindrical body of the lower housing has a slot, a step and a cut out at its rear end portion. In a locked state of the personal defense device, the extended head of the plunger abuts the step of the lower housing while in an actuated state of the personal defense device, the extended head of the plunger abuts the cut out of the lower housing. The slot provided in the lower housing is for the proper fitment of the plunger inside the lower housing.

According to an embodiment, a front end of the upper housing of the plunger assembly abuts against the vertical wall of the cover of the PCB housing and obstructs removal or opening of the cover. Therefore to open or remove the cover of the printed circuit board housing, the plunger assembly has to be dislocated/displaced with respect to the printed circuit board housing such that the upper housing of the plunger assembly no longer abuts the vertical wall of the cover. The plunger assembly may be dislocated with respect to the printed circuit board housing from a position of abutment to a non-abut position with the upper housing through relative rotation of the barrel assembly and the plunger assembly.

According to an embodiment, when the personal defense device is in the locked state, the extended head of the plunger abuts the step of the lower housing. The spring in the canister housing is in an expanded state which normally pushes the canister away from the third opening present in the canister housing.

According to an embodiment, the unlocked state of the personal defense device is achieved when the user wants to use the personal defense device. User applies force on the extended head of the plunger in a clockwise or anti-clockwise direction depending upon position of the cut-out with respect to the step in the cylindrical body of the lower housing of the plunger assembly until the extended head gets removed from the step of the lower housing and enters the cut-out. In the unlocked state, the extended head of the plunger does not abut the step of the lower housing anymore and is free to be actuated. The spring in the canister housing is still in an expanded state which normally pushes the canister away from the third opening present in the canister housing.

According to an embodiment, a semi-actuated state of the personal defense device is achieved when the user applies force on the extended head of the plunger. This force of action causes the spring to get compressed which pushes the canister towards the third opening present in the canister housing which further causes the nozzle of the canister to abut the third opening.

According to an embodiment, a fully-actuated state of the personal defense device is achieved when the user applies force on the extended head of the plunger till the extended head of the plunger abuts the cut out of the lower housing. This force of action causes the spring to get fully compressed, which causes the nozzle of the canister to come out from the third opening of the canister housing thereby actuating release of the attack repellant chemical through the third opening in a direction in which the personal defense device is aimed.

According to an embodiment, the attack repellant chemical is released from the canister in a direction similar to a direction of application of force on the plunger.

Accordingly, a feature and advantage of the present disclosure is its ability to accurately propel a stream of personal defense liquid or an irritant for example pepper spray, mace and a chemical irritant to eyes and/or skin.

Yet another feature and advantage of the present disclosure is its ability to provide a reusable personal defense device.

Another feature and advantage of the present disclosure is its ability to attract the attention of nearby persons in an emergency situation.

Another feature and advantage of the present disclosure is its full effectiveness in accomplishing its intended purposes.

These and other objects, features and advantages of the disclosure will become more apparent to those ordinarily skilled in the art after reading the following detailed description in light of the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
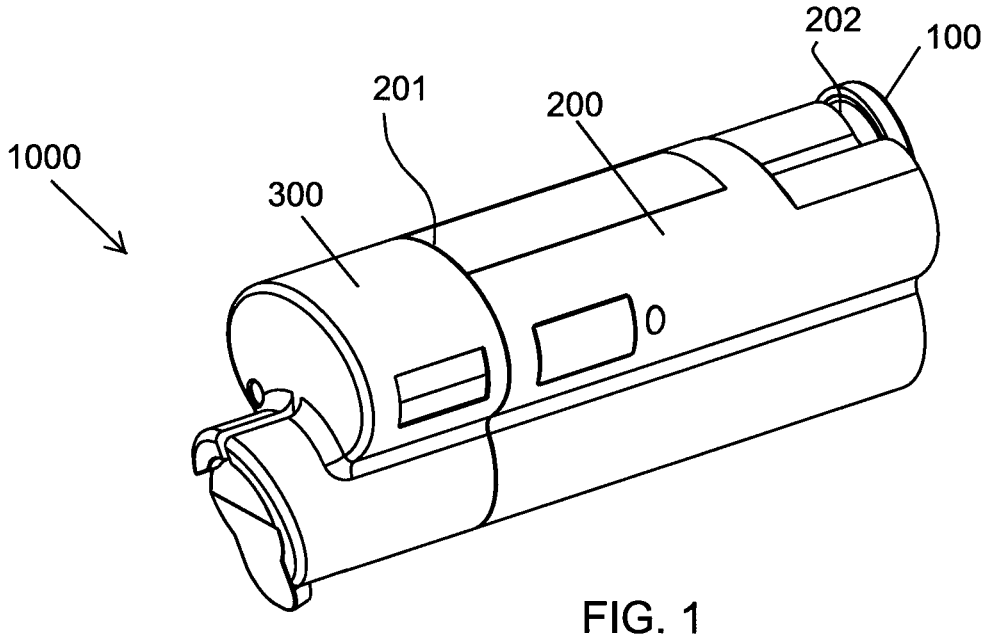
FIG. 1 illustrates an isometric view of a personal defense device according to an embodiment of present disclosure.

To facilitate understanding, identical reference numerals have been used, where possible, to designate identical elements that are common to the FIGS. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 2:
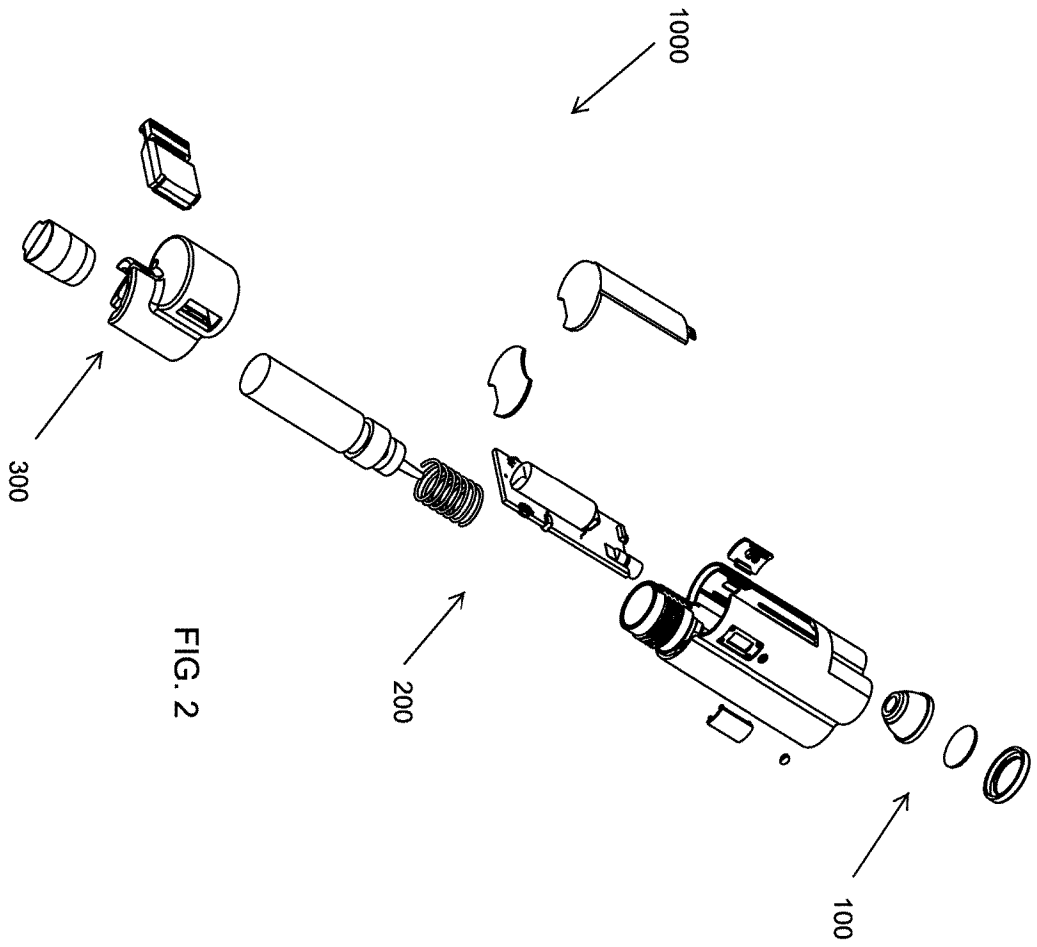
FIG. 2 is an exploded view of the personal defense device of FIG. 1.

A personal defense device 1000 as seen in FIG. 1 comprises a reflector assembly 100, a barrel assembly 200 and a plunger assembly 300 in accordance with the present disclosure. FIG. 2 depicts an exploded view of the personal defense device 1000. The reflector assembly 100 is attached to the barrel assembly 200 which is further attached to the plunger assembly 300. According to the present embodiment, the barrel assembly 200 includes a proximal end 201 and a distal end 202. The reflector assembly 100 is attached at the distal end 202 of the barrel assembly 200. The plunger assembly 300 is attached at the proximal end 201 of the barrel assembly 200.

According to an embodiment, the barrel assembly 200 is attached to the plunger assembly 300 by threaded engagement. Alternatively, any known affixation means or mechanisms either mechanical like snap fit, or adhesive-based or the like can be used to attach the barrel assembly 200 with the plunger assembly 300.

Figure 3A:
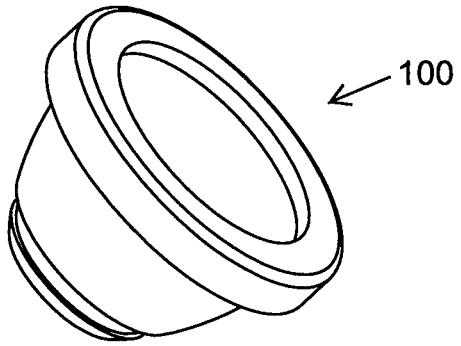
FIG. 3A is an isometric view of a reflector assembly of the personal defense device of FIG. 1.
Figure 3B:
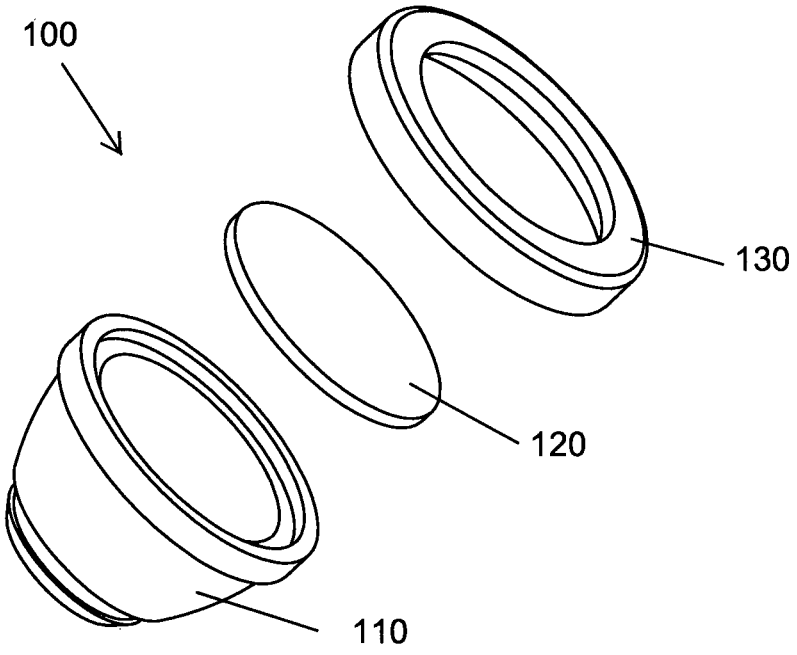
FIG. 3B is an exploded view of the reflector assembly of FIG. 3A.

FIG. 3A depicts the reflector assembly 100 and FIG. 3B is an exploded view of the reflector assembly 100 of FIG. 3A. As shown in FIG. 3B, the reflector assembly 100 comprises a reflector 110, a lens 120 and a cover 130. The cover 130 is combined with the lens 120 to protect the reflector 110 from dust or other physical damage. Further, the lens 120 is used to focus the flash light generated by a flash LED 251 (shown in FIG. 4B). According to an embodiment, an adhesive is applied on an outside surface of the reflector 110 so that it can be attached to the barrel assembly 200. Alternatively, the reflector 110 can be attached to the barrel assembly 200 by any known affixation means or mechanisms for e.g. by threads, snap fit or the like. The reflector assembly 100 is attached at a first opening 285 (see FIG. 4B) of the barrel assembly 200.

Figure 4A:
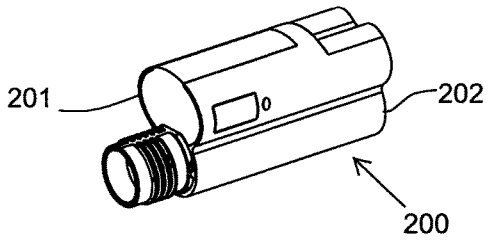
FIG. 4A is an isometric view of a barrel assembly of the personal defense device of FIG. 1.
Figure 4B:
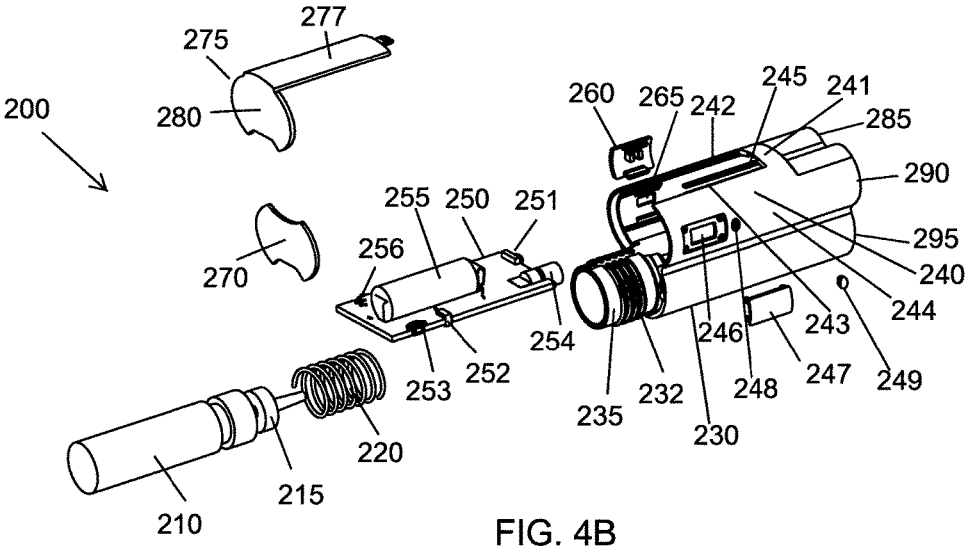
FIG. 4B is an exploded view of the barrel assembly of FIG. 4A.

FIG. 4A depicts the barrel assembly 200 and FIG. 4B is an exploded view of the barrel assembly 200 of FIG. 4A. As shown in FIG. 4B, the barrel assembly 200 comprises a replaceable canister 210 having a compressible nozzle 215 at its distal end. The nozzle 215 is inserted into a spring 220. The canister 210 serves as a receptacle for an attack repellant chemical selected from pepper, mace and a chemical irritant to eyes and/or skin. A canister housing 230 is provided to receive the spring 220 and the replaceable canister 210 having the compressible nozzle 215. Threads 232 are formed on a neck 235 of the canister housing 230. Alternately, the neck 235 may have protrusions or grooves. According to another embodiment, the canister may not be replaceable.

A PCB (Printed circuit board) housing 240 is provided above the canister housing 230 to receive a PCB (Printed circuit board) assembly 250 which carries a battery 255 according to an embodiment. According to alternate embodiments, the PCB assembly 250 carries more than one battery. The PCB (Printed circuit board) assembly 250 further comprises a target pointer which in this case is a Laser pointer 254, a flash light source which in this case is an LED bulb 251, an indicator for battery which in this case is an LED bulb 252; and two switches 253 and 256. The PCB housing 240 has a channel 245 which guides insertion of the PCB assembly 250 into the PCB housing 240. A PCB stopper 270 is removably attached at an insertion end of the PCB housing 240 to prevent any accidental movement of the PCB assembly 250 out of the PCB housing 240. A cut out 243 is provided on a top surface 241 of the PCB housing 240. A cover 275 is attached to the cut out 243. Further, the cover 275 comprises a horizontal wall 277 and a vertical wall 280 which are provided to cover the PCB assembly 250 and the PCB stopper 270 respectively. A side wall 242 of the PCB housing 240 has a slot 265 to receive a slider button 260. The slider button 260 activates or deactivates the switch 256 on the PCB assembly 250 to switch ON/OFF both the target pointer 254 and the flash light source 251. Another side wall 244 of the PCB housing 240 has a slot 246 and a cavity 248. The slot 246 is to receive a push button 247. The push button 247 activates or deactivates the switch 253 on the PCB assembly 250 to switch ON/OFF the battery indicator 252. The battery indicator 252 indicates that the personal defense device 1000 is powered ON or OFF and displays the level of charging of the battery 255. The cavity 248 receives a light pipe 249. The light pipe 249 is used for transporting or distributing light from the battery indicator 252 to outside. Light from the flash light source 251 emits out from the reflector assembly 100 at the first opening 285 of the PCB housing 240 while laser beam from the target pointer 254 emits out from a second opening 290 of the PCB housing 240. A third opening 295 in the canister housing 230 releases the attack repellant chemical from the canister 210.

Figure 5A:
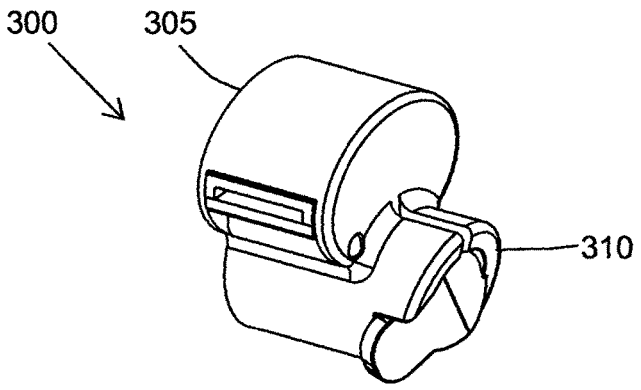
FIG. 5A is an isometric view of a plunger assembly of the personal defense device of FIG. 1.
Figure 5B:
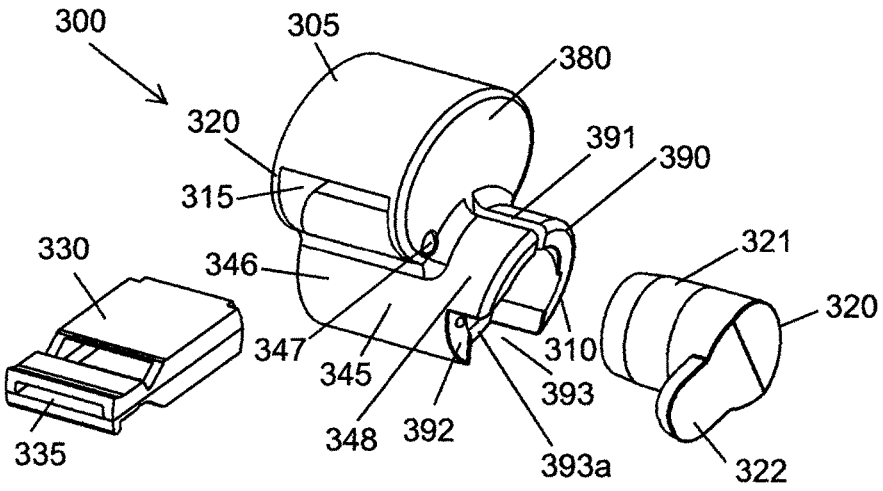
FIG. 5B is an exploded view of the plunger assembly of FIG. 5A.

FIG. 5A depicts the plunger assembly 300 and FIG. 5B is an exploded view of the plunger assembly 300 of FIG. 5A. The plunger assembly 300 has a front end 305 and a rear end 310. The plunger assembly 300 comprises an upper housing 380 and a lower housing 390. The upper housing 380 includes an open ended cavity 315 extending from aside surface 320 in a direction transverse to a longitudinal axis of the upper housing 380 to receive an alarm which in this case is a whistle 330. The whistle 330 has a passageway 335 to direct a stream of air which is blown by the user. The whistle 330 functions as an alarm either to attract the attention of nearby persons for assistance especially in an emergency or to stun or disorient an attacker. A cavity 347 is formed in the upper housing 380 to receive a holding strap (not shown) so that the user can carry the personal defense device 1000 easily. The lower housing 390 has a hollow cylindrical body 345. The lower housing 390 is removably engaged to the canister housing 230. More particularly, a front end portion 346 of the lower housing 390 receives the barrel assembly 200 and it has internal threads (not shown) to engage with the threads 232 formed on the neck 235 of the canister housing 230. A rear end portion 348 of the lower housing 390 receives a plunger 320. The plunger 320 has a hollow cylindrical body 321 and an extended head 322. The cylindrical body 345 of the lower housing 390 at the rear end portion 348 has a slot 391, a step 392 and a cut out 393 having a bottom wall 393*a*. In a locked state of the personal defense device 1000, the extended head 322 of the plunger 320 abuts the step 392 of the lower housing 390 while in an actuated state of the personal defense device 1000, the extended head 322 of the plunger 320 abuts the cut out 393 of the lower housing 390. The slot 391 provided in the lower housing 390 is for the proper fitment of the plunger 320 inside the lower housing 390.

According to an embodiment, the front end 305 of the upper housing 380 of the plunger assembly 300 abuts against the vertical wall 280 of the cover 275 of the PCB housing 240 and hence obstructs removal or opening of the cover 275. Therefore, to open or remove the cover 275 of the printed circuit board housing 240, the plunger assembly 300 has to be dislocated/displaced with respect to the printed circuit board housing 240 such that the upper housing 280 of the plunger assembly 300 no longer abuts the vertical wall 280 of the cover 275.

Figure 6A:
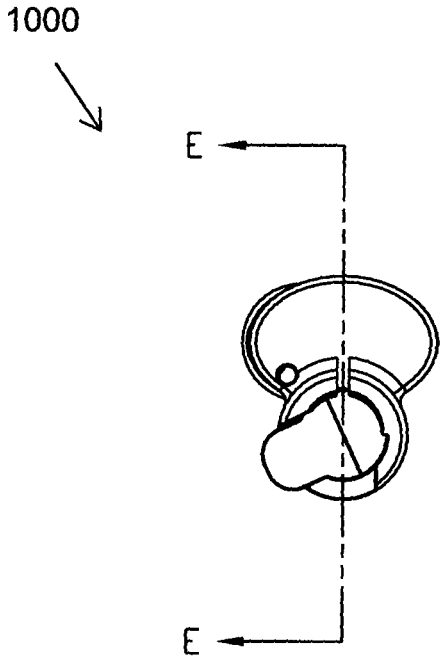
FIG. 6A is a rear view of the personal defense device of FIG. 1 in a locked state.
Figure 6B:
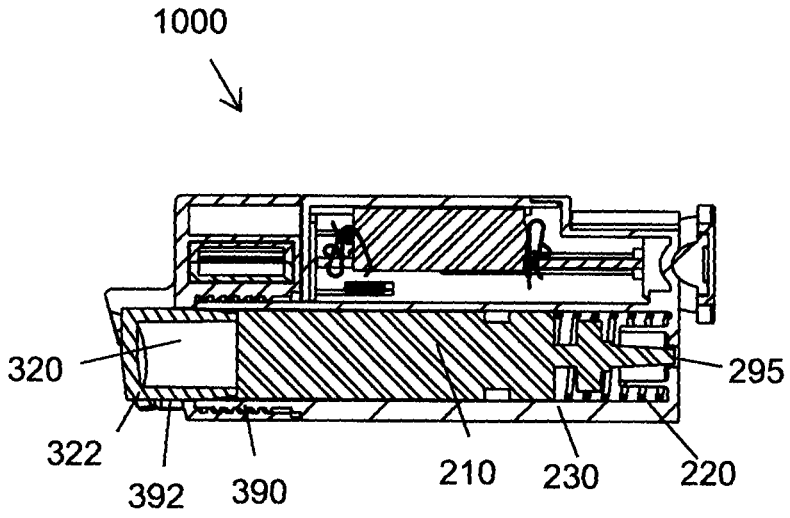
FIG. 6B is a cross-sectional view along axis E-E of FIG. 6A.

FIG. 6A is a rear view of the personal defense device of FIG. 1 in locked state and FIG. 6B is a cross sectional view along axis E-E of FIG. 6A. When the personal defense device 1000 is in locked state, the extended head 322 of the plunger 320 abuts the step 392 of the lower housing 390. The spring 220 in the canister housing 230 is in an expanded state which normally pushes the canister 210 away from the third opening 295 of the canister housing 230.

Figure 6C:
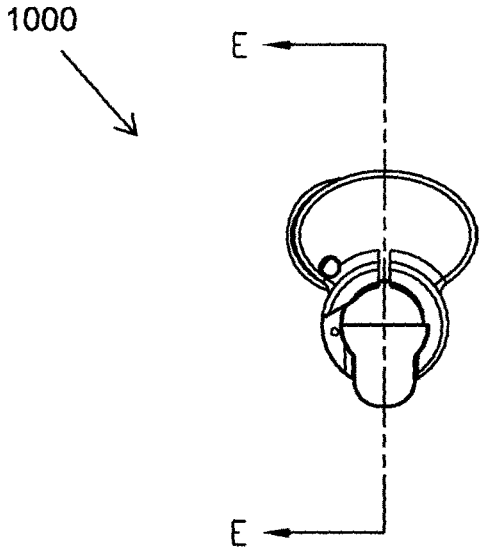
FIG. 6C is a rear view of the personal defense device of FIG. 1 in an unlocked state.
Figure 6D:
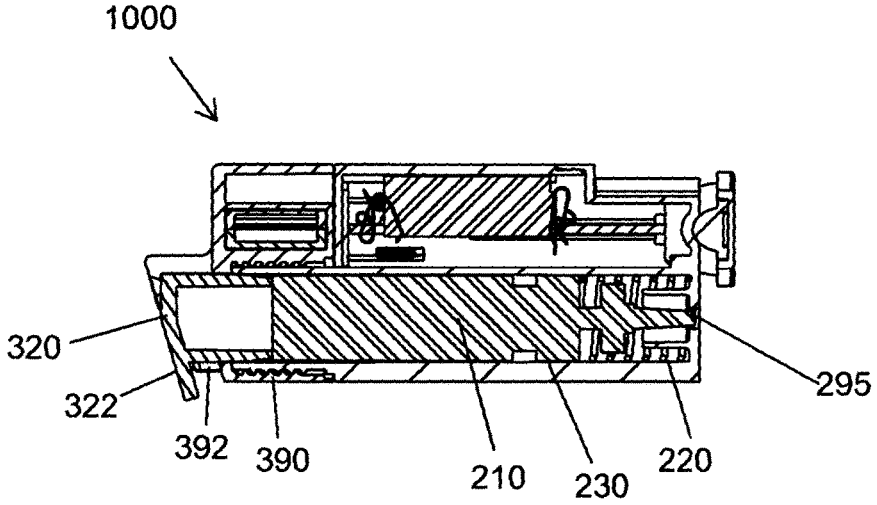
FIG. 6D is a cross-sectional view along axis E-E of FIG. 6C.

FIG. 6C is a rear view of the personal defense device of FIG. 1 in an unlocked state and FIG. 6D is a cross sectional view along axis E-E of FIG. 6C. The unlocked state of the personal defense device 1000 is achieved when the user wants to use the personal defense device 1000. The user applies force on the extended head 322 of the plunger 320 towards one direction, clockwise or anticlockwise depending upon the position of the cut out 393 with respect to the step 392. In present embodiment, the user applies force on the extended head 322 of the plunger 320 towards the anti-clockwise direction until the extended head 322 gets removed from the step 392 of the lower housing 390 and enters into the cut out 393. The extended head 322 of the plunger 320 does not abut the step 392 of the lower housing 390 anymore and is free to be actuated. The spring 220 in the canister housing 230 is still in an expanded state which normally pushes the canister 210 away from the third opening 295.

Figure 6E:
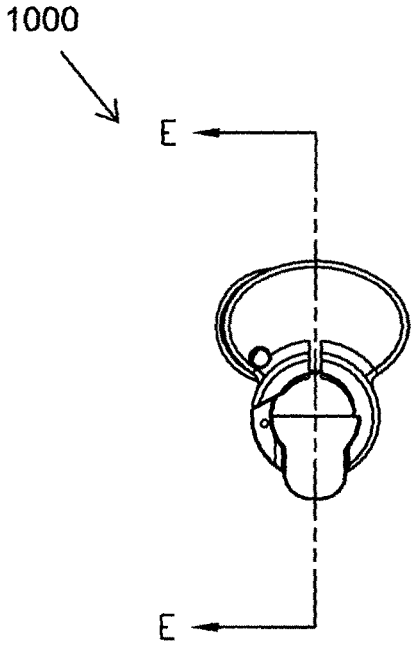
FIG. 6E is a rear view of the personal defense device of FIG. 1 in a semi-actuated state.
Figure 6F:
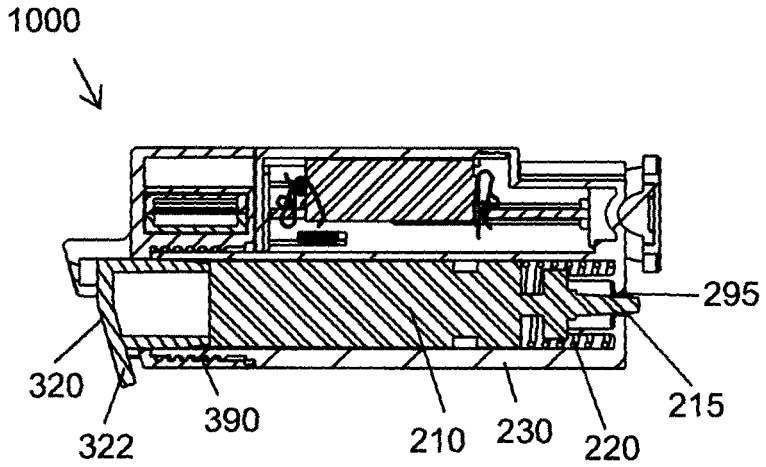
FIG. 6F is a cross-sectional view along axis E-E of FIG. 6E.

FIG. 6E is a rear view of the personal defense device of FIG. 1 in semi-actuated state and FIG. 6F is a cross sectional view along axis E-E of FIG. 6E, when the personal defense device 1000 is semi-actuated by user. This semi-actuated state is achieved when the user applies force on the extended head 322 of the plunger 320. This force of action causes the spring 220 to get compressed which pushes the canister 210 towards the third opening 295 which further causes the nozzle 215 of the canister 210 to abut the third opening 295.

Figure 6G:
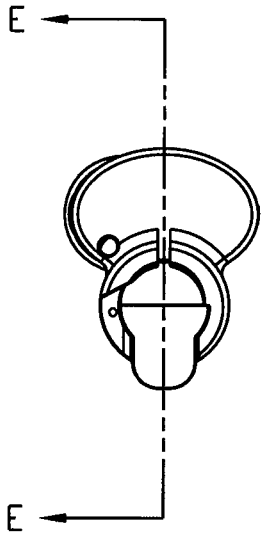
FIG. 6G is a rear view of the personal defense device of FIG. 1 in a fully-actuated state.
Figure 6H:
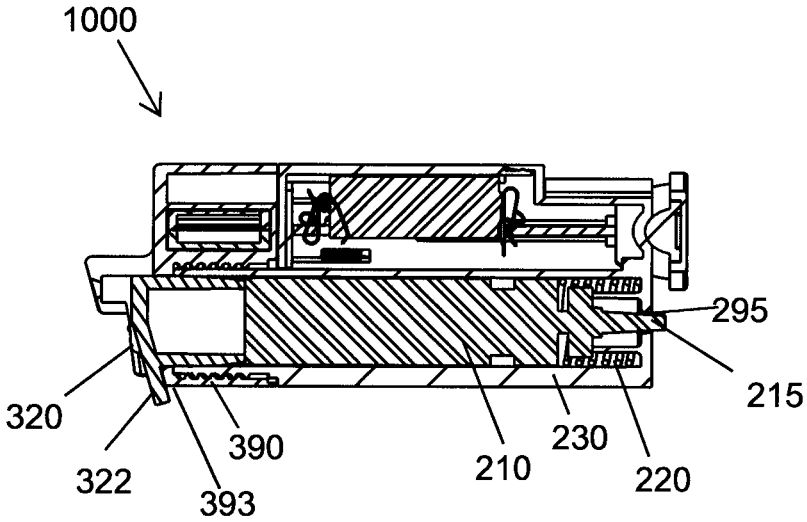
FIG. 6H is a cross-sectional view along axis E-E of FIG. 6G.

FIG. 6G is a rear view of the personal defense device of FIG. 1 in fully-actuated state and FIG. 6H is a cross sectional view along axis E-E of FIG. 6G when the personal defense device 1000 is fully-actuated. This fully-actuated state is achieved when the user applies force on the extended head 322 of the plunger 320 till the extended head 322 of plunger 320 abuts a bottom wall 393*a* of the cut out 393 of the lower housing 390. This force of action causes the spring 220 to get fully compressed, which causes the nozzle 215 of the canister 210 to come out from the third opening 295 of the canister housing 230 thereby actuating release of the attack repellant chemical through the third opening 295 in a direction in which the personal defense device 1000 is aimed. The attack repellant chemical is released from the canister 210 in a direction similar to a direction of application of force on the plunger 320.

In an embodiment under consideration, the personal defense device 1000 comprising a flash light source 251, a battery indicator 252, a target pointer 254, an alarm 330 and a canister 210 cooperatively operate as a self-defense means enabling the user of the device to stun, disorient or disable an attacker and/or attract the attention of nearby persons for assistance especially in an emergency. When a need arises to employ the device for self-defense purposes, the user simply presses the slider button 260 provided in the barrel assembly 200 to activate the target pointer 254 and the flash light source 251 together to point the Laser beam and the flash light towards the assailant. On further moving the extended head 322 of the plunger 320 from a locked state to an unlocked state and then actuating by applying force on it, causes the attack repellant chemical to be released in form of a spray from the nozzle 215 of the canister 210.

The user of the personal defense device 1000 is able to better handle a situation and summon help while the assailant is suffering from the effects of the attack repellant chemical.

Although the present disclosure has been described herein with reference to particular embodiments, it is to be understood that these embodiments are merely illustrative of certain principles and applications of the present disclosure. It is further to be understood that numerous modifications may be made to the illustrative embodiments and that other arrangements may be devised without departing from the present disclosure.

What is claimed is:

1. A personal defense device comprising:

a reflector assembly, a barrel assembly and a plunger assembly;

wherein the barrel assembly includes a proximal end and a distal end;

wherein the reflector assembly is attached to the barrel assembly at a first opening provided at the distal end of the barrel assembly;

wherein the plunger assembly is attached to the barrel assembly at the proximal end of the barrel assembly;

wherein the reflector assembly comprises a reflector, a lens and a cover to protect the lens;

wherein the barrel assembly comprises a printed circuit board housing and a canister housing;

wherein the printed circuit board housing receives a printed circuit board assembly;

wherein the canister housing receives a replaceable canister having a compressible nozzle at its distal end;

wherein the replaceable canister serves as a receptacle for an attack repellant chemical;

wherein the printed circuit board assembly includes at least one battery;

wherein the plunger assembly comprises an upper housing and a lower housing;

wherein the lower housing of the plunger assembly is removably engaged to the canister housing;

wherein the upper housing of the plunger assembly includes an open ended cavity which extends in a direction transverse to a longitudinal axis of the upper housing; and wherein the open ended cavity is configured to receive and retain an alarm.

2. A personal defense device according to claim 1, wherein the lower housing of the plunger assembly receives a neck of the canister housing; and wherein the lower housing has an engagement means selected from threads, snap fitment and j-lock to removably engage with a complementary engagement means formed on the neck of the canister housing.

3. A personal defense device according to claim 1, wherein the alarm is a whistle and wherein the whistle is removably retained in the open ended cavity of the upper housing of the plunger assembly.

4. A personal defense device according to claim 1, wherein the printed circuit board assembly further includes a laser pointer, a flash light source, an indicator for battery and at least one switch.

5. A personal defense device according to claim 4, wherein a rear end portion of the lower housing of the plunger assembly receives a plunger and wherein the plunger has an extended head.

6. A personal defense device according to claim 5, wherein in a locked state of the personal defense device, the extended head of the plunger abuts a step present in the rear end portion of the lower housing and wherein in an actuated state of the personal defense device, the extended head of the plunger abuts a bottom wall of a cut out present in the rear end portion of the lower housing.

7. A personal defense device according to claim 1, wherein the canister housing is configured to receive a spring and the replaceable canister; and wherein the compressible nozzle of the replaceable canister is inserted inside the spring.

8. A personal defense device according to claim 1, wherein the attack repellant chemical is pepper, mace or a chemical irritant to eyes and/or skin.

9. A personal defense device according to claim 4, wherein the flash light source is a flash LED bulb or a conventional source of light capable of producing a high intensity light.

10. A personal defense device according to claim 1, wherein a PCB stopper is removably attached at an insertion end of the printed circuit board housing to prevent any accidental movement of the printed circuit board assembly out of the printed circuit board housing.

11. A personal defense device according to claim 10, wherein a cut out is provided on a top surface of the printed circuit board housing and a cover is attached to the cut out; and wherein the cover comprises a horizontal wall and a vertical wall which are provided to cover the printed circuit board assembly and the PCB stopper respectively.

12. A personal defense device according to claim 4, wherein a side wall of the printed circuit board housing has a slot to receive a slider button and wherein the slider button activates or deactivates the at least one switch on the printed circuit board assembly to switch ON/OFF both the laser pointer and the flash light source.

13. A personal defense device according to claim 4, wherein a side wall of the printed circuit board housing has a slot and a cavity; wherein the slot receives a push button configured to activate or deactivate the at least one switch on the printed circuit board assembly to switch ON/OFF the battery indicator; and wherein the cavity is configured to receive a light pipe for transporting or distributing light from the battery indicator to outside of the printed circuit board housing.

14. A personal defense device comprising:

a reflector assembly, a barrel assembly and a plunger assembly;

wherein the barrel assembly includes a proximal end and a distal end;

wherein the barrel assembly includes a first opening, a second opening and a third opening at the distal end;

wherein the reflector assembly is attached to the barrel assembly at the first opening provided at the distal end of the barrel assembly;

wherein the plunger assembly is attached to the barrel assembly at the proximal end of the barrel assembly;

wherein the reflector assembly comprises a reflector, a lens and a cover to protect the lens;

wherein the barrel assembly comprises a printed circuit board housing and a canister housing;

wherein the printed circuit board housing receives a printed circuit board assembly;

wherein the printed circuit board assembly includes at least one battery, a laser pointer, a flash light source and at least one switch;

wherein the canister housing is configured to receive a spring and a canister having an attack repellant chemical;

wherein a light from the flash light source emits out from the reflector assembly at the first opening, a laser beam from the laser pointer emits out from the second opening and the attack repellant chemical of the canister is released from the third opening;

wherein the plunger assembly comprises an upper housing and a lower housing;

wherein a front end of the lower housing receives a neck of the canister housing; and wherein a rear end portion of the lower housing receives a plunger.

15. A personal defense device according to claim 14, wherein the rear end portion of the lower housing of the plunger assembly includes a step and a cut out; and wherein the plunger has an extended head.

16. A personal defense device according to claim 15, wherein when the personal defense device is in a locked state, the extended head of the plunger abuts the step of the lower housing, and the spring in the canister housing is in an expanded state which pushes the canister away from the third opening.

17. A personal defense device according to claim 15, wherein when the personal defense device is in an unlocked state, the extended head of the plunger is moved from the step of the lower housing into the cut-out, and the spring in the canister housing is in an expanded state.

18. A personal defense device according to claim 15, wherein when the personal defense device is in a fully-actuated state, the extended head of plunger is depressed till the extended head of plunger abuts a bottom wall of the cut out of the lower housing, and the spring gets fully compressed which causes a nozzle of the canister to come out from the canister housing and release the attack repellant chemical through the third opening.

19. A personal defense device comprising:

a barrel assembly and a plunger assembly;

wherein the barrel assembly includes a proximal end and a distal end;

wherein the plunger assembly is attached to the barrel assembly at the proximal end of the barrel assembly;

wherein the barrel assembly comprises a printed circuit board housing and a canister housing;

wherein the printed circuit board housing receives a printed circuit board assembly;

wherein the canister housing receives a canister having an attack repellant chemical;

wherein the plunger assembly comprises an upper housing and a lower housing;

wherein the lower housing is removably engaged with the canister housing;

wherein a cut out is provided on a top surface of the printed circuit board housing and a cover is attached to the cut out, and wherein the cover comprises a horizontal wall and a vertical wall which are provided to cover the printed circuit board assembly; and wherein a front end of the upper housing of the plunger assembly abuts against the vertical wall of the cover and obstructs removal or opening of the cover.

* * * * *